United States Patent [19]

Morishita et al.

[11] 4,099,974

[45] Jul. 11, 1978

[54] ELECTROLESS COPPER SOLUTION

[75] Inventors: Hirosada Morishita; Mineo Kawamoto; Motoyo Wajima; Kanji Murakami, all of Hitachi, Japan

[73] Assignee: Hitachi, Ltd., Japan

[21] Appl. No.: 665,708

[22] Filed: Mar. 10, 1976

[30] Foreign Application Priority Data

Mar. 14, 1975 [JP] Japan ..... 50/30147

[51] Int. Cl.[2] ..... C23C 3/02

[52] U.S. Cl. ..... 106/1.23; 106/1.26; 427/437

[58] Field of Search ..... 106/1, 1.23, 1.26; 427/92, 98, 305, 383, 437

[56] References Cited

U.S. PATENT DOCUMENTS

| | | | |
|---|---|---|---|
| 3,377,174 | 4/1968 | Torigai et al. | 106/1 |
| 3,472,664 | 10/1969 | Bastenbeck et al. | 106/1 |
| 3,607,317 | 9/1971 | Schneble | 106/1 |
| 3,615,736 | 10/1971 | Stone | 106/1 |
| 3,804,638 | 4/1974 | Jonker et al. | 106/1 |

OTHER PUBLICATIONS

Saubestre, *Plating,* "Stabilizing Electroless Plating Solutions", Jun., 1972, vol. 59, pp. 563–566.

*Primary Examiner*—Lorenzo B. Hayes
*Attorney, Agent, or Firm*—Craig & Antonelli

[57] ABSTRACT

An electroless copper solution capable of forming an electroless deposited copper film having as a higher elongation as that of electro deposited copper film is provided, which is characterized by adding either 2,2'-dipyridyl or 2,9-dimethyl-1,10-phenanthroline, and polyethylene glycol to the well known electroless copper solution containing a copper salt, such as cupric sulfate, a complexing agent such as ethylenediaminetetraacetic acid, a reducing agent such as formalin, and a pH-adjusting agent such as alkali hydroxide as main components.

The present copper solution can provide not only a higher elongation of deposited film, but also higher depositing rate, about 3 - 4 μm/hr, which is equal or superior to that of the conventional art.

8 Claims, 5 Drawing Figures

ELECTROLESS COPPER SOLUTION

The present invention relates to an electroless copper solution capable of providing an electroless deposited copper film having high elongation.

The conventional electroless copper solution consists of a copper salt, a complexing agent such as ethylenediaminetetraacetic acid, a reducing agent such as formalin, and a pH-adjusting agent, but has a poor stability, and the electroless deposited copper film resulting from the conventional electroless copper solution is generally brittle. Thus, various attempts have been made. For example, various additives such as cobalt sodium cyanide (Japanese patent publication No. 32125/70), sodium tetrapyrophosphate (U.S. Pat. No. 3635758), polysiloxane (U.S. Pat. No. 3,475,186), polyethylene oxide (U.S. Pat. No. 3,607,317), phenanthroline (U.S. Pat. No. 3,615,736) and 2,2'-dipyridyl (E. B. Sanbestre: Plating, June, pages 563 – 566, 1972) are used. However, according to the test results obtained by the present inventors, these additives are all effective for improving flexibility or tensile strength of the deposited films, and also improving stability of the electroless copper solutions, but the elongation of the deposited films is not much improved. In the case of printed circuit boards, etc. having the most practical film thickness of 30 to 40 μm, the upper limit of the elongation of the films is about 3%, and any higher elongation cannot be obtained.

As far as the electro copper plating process applied to printed circuit boards, etc. is concerned, it is reported that copper films having film thickness of 30 to 40 μm have elongation of 4% or more (IPC-CF-150B Standard Spc., Copper Foil for Printed Wiring Applications, 1971). The high elongation has a great effect, in the case of printed board, etc., upon absorption of strains caused by mechanical processing after the formation of circuits, and prevention of breaking in throughhole circuit due to expansion and contraction originating from thermal hysteresis. The deposited film obtained from the conventional electroless copper solution has not sufficient elongation, and thus copper films having sufficient characteristics cannot be obtained for the printed circuit requiring film thickness of 30 to 40 μm.

As a plating solution capable of forming deposited film having a film thickness of 30 to 40 μm and elongation of 3% or more, a process based on the addition of sodium cyanide as an additive has been proposed (U.S. Pat. No. 3,095,309), but the depositing rate is as low as 1 to 2 μm/hr, and a plating working time is thus disadvantageously prolonged. Furthermore, the use of cyanide is a problem from the viewpoint of environmental pollution. Thus, an electroless copper solution satisfying both elongation of plating film and depositing rate has not been so far available.

An object of the present invention is to provide an electroless deposited copper film having elongation equivalent to that of the electro deposited copper film according to an economically distinguished electroless copper plating process, as compared with the conventional electro copper plating process.

Another object of the present invention is to provide an electroless copper solution having depositing rate as high as, or higher than that of the conventional electroless copper solution.

Other objects and features of the present invention will be made clear from the following detailed explanation, referring to Examples.

Now, the present invention will be described in detail, referring to the accompanying drawings.

Figure 1:
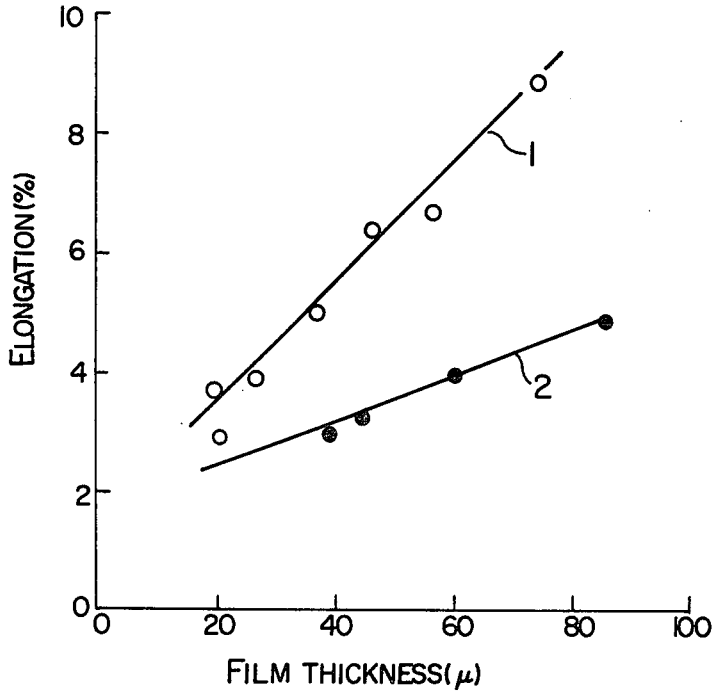
FIG. 1 is a graph showing relations between a film thickness of electroless deposited film, and elongation.

The present invention is characterized by adding either 2,2'-dipyridyl or 2,9-dimethyl-1,10-phenanthroline, and polyethylene glycol to a plating solution containing a copper salt, a complexing agent, a reducing agent and a pH-adjusting agent as main components.

2,2'-dipyridyl is added to the solution in a range of 5 to 300 mg/l. In the case of less than 5 mg/l, a deposited film having the elongation of 3% or more cannot be obtained for a film thickness of 30 to 40 μm. In the case of more than 300 mg/l, a depositing rate is unpreferably decreased to less than 3 μm/hr. In view of the elongation of deposited film, depositing rate, economy and workability, a preferable concentration of 2,2'-dipyridyl is 10 to 50 mg/l.

On the other hand, 2,9-dimethyl-1,10-phenanthroline is added to the solution in a range of 1 to 50 mg/l. In the case of less than 1 mg/l, the desired percent elongation cannot be obtained, and in the case of more than 50 mg/l, the depositing speed is given an adverse effect, similarly to the case of 2,2'-dipyridyl.

As far as an effect upon the improvement of the elongation of deposited film is concerned, it is preferable to add 2,2'-dipyridyl rather than 2,9-dimethyl-1,10-phenanthroline.

As to the polyethylene glycol to be used togehter with either 2,2'-dipyridyl or 2,9 -dimethyl-1,10-phenanthroline, that is, the feature of the present invention, polyethylene glycol having molecular weight in a range of 200 to 6,000 are used. In view of the effect upon the improvement of elongation, solubility in the copper solution, etc. it is preferable to use polyethylene glycol having molecular weights of 400 to 2,000.

The amount of polyethylene glycol to be added depends even upon the molecular weight, and thus is hard to determine, but at least 1 g/l of polyethylene glycol must be added to the solution. In the case of less than 1 g/l, the elongation fails to reach 3%. A preferable amount of the polyethylene glycol is at least 3 g/l, if the elongation and depositing rate are taken into account, though the amount depends also upon the amount of 2,2'-dipyridyl or 2,9-dimethyl-1,10-phenanthroline added. However, in the case of more than 100 g/l, , the depositing rate is decreased to less than 3 μm/hr in terms of the deposited film thickness.

According to the present invention, a deposited copper film having elongation equivalent to that of the electro deposited copper film can be obtained by a combination of said additives, but such effect cannot be obtained by using the individual additives alone.

The electroless copper solution used as a basis in the present invention is an aqueous electroless copper solution consisting of a cupric salt, a complexing agent, a reducing agent and an alkali hydroxide. As the cupric salt, any of the ordinary cupric salts such as cupric sulfate, cupric nitrate, cupric chloride, etc. can be used. As the complexing agent, ethylene diaminetetraacetic acid, N,N,N',N'-tetrakis(2-hydroxypropyl)ethylenediamine, etc. can be used. As the reducing agent, formalin is used. The alkali hydroxide is added to the solution to adjust the pH of the plating solution, and includes sodium hydroxide and potassium hydroxide.

In order to attain depositing rate of 3 μm/hr, or higher, it is preferable to carry out the electroless copper deposition under the following basic conditions:
Cupric salt concentration: 15 g/l or less
pH: 13.5 or less
Solution temperature: 80° C or less Even if the electroless copper plating is continuously carried out for about 30 hours under said basic conditions, a stable plating operation can be assured almost without any deposition of copper onto the surfaces of plating tank wall, jigs, etc.

When ethylenediaminetetraacetic acid is used as the complexing agent, deposition of copper takes place, rendering the stability of the solution worse, unless at least one mole of ethylenediaminetetraacetic acid is added to the solution per one mole of cupric salt in the plating solution. Furthermore, unless at least 2 ml/l formalin in the form of an aqueous 37% solution is added to the solution, depositing rate of 3 μm/hr cannot be maintained.

Now, the present invention will be described in detail, referring to Examples.

EXAMPLES 1 - 5 and Comparative Examples 1 - 3

Elongations of deposited films obtained by use of electroless copper solution of the present invention were compared.

Stainless steel plates (200 mm long × 160 mm wide × 1.5 mm thick) having polished surfaces were dipped into an aqueous 5% sodium hydroxide solution at 80° C for 2 minutes and then rinsed with water, and dipped in 15% hydrochloric acid at room temperature for 2 minutes. Then, the stainless steel plates were dipped at room temperature for 5 minutes into an aqueous solution prepared by adding 100 g of stanneous chloride and 100 ml of concentrated hydrochloric acid to water to make 1 l, and then rinsed with water. Then, the stainless steel plates were dipped at room temperature for 5 minutes in an aqueous solution prepared by adding 0.5 g of palladium chloride and 10 ml of concentrated hydrochloric acid to water to make 1 l, then rinsed with water, further dipped in 15% hydrochloric acid at room temperature for 5 minutes, and rinsed with water.

Then, the stainless steel plates were dipped individually in plating solutions having the compositions shown in Table 1 at 70° C while stirring the solutions, and copper plating films of 35 to 40 μm were obtained thereby.

Table 1

| | Example | | | | | Comparative Example | | |
|---|---|---|---|---|---|---|---|---|
| | 1 | 2 | 3 | 4 | 5 | 1 | 2 | 3 |
| $CuSO_4 \cdot 5H_2O$ (g/l) | 10 | 5 | 5 | 5 | 5 | 10 | 10 | 5 |
| EDTA[1] (g/l) | 30 | 30 | 30 | 30 | 30 | 30 | 30 | 30 |
| HCHO 37 % aqueous solution (g/l) | 20 | 10 | 20 | 10 | 20 | 20 | 20 | 20 |
| PEG[2] MW[3] 600 | 10 | 10 | — | — | — | 10 | — | — |
| MW 1,500 | — | — | 25 | 30 | 25 | — | — | — |
| 2,9-dimethyl-1,10-phenanthroline (mg/l) | — | — | — | — | 3 | — | — | 3 |
| 2,2'-dipyridyl (mg/l) | 20 | 20 | 20 | 40 | — | — | 20 | — |
| pH [20° C] | 13.0 | 12.5 | 13.0 | 13.0 | 12.5 | 13.0 | 13.0 | 12.5 |

Note:
[1]Ethylenediaminetetraacetic acid
[2]Polyethylene glycol
[3]Molecular weight The deposited copper films formed on said stainless steel plates were peeled off from the substrate surfaces, and cut to pieces (10 mm wide × 50 mm long), which were subjected to measurement of elongation and tensile strength by means of a tension tester. The results are shown in Table 2, where a depositing rate (μm of deposited film thickness/hr) and thickness (μm) of the deposited films formed are shown at the same time.

Table 2

| | | Elongation (%) | Tensile strength (kg/mm²) | Depositing rate (μm/hr) | Deposited film thickness (μm) |
|---|---|---|---|---|---|
| Example | 1 | 5.1 | 42.8 | 4.3 | 36.3 |
| | 2 | 3.9 | 41.5 | 4.0 | 39.9 |
| | 3 | 3.9 | 42.1 | 4.1 | 36.8 |
| | 4 | 6.3 | 50.3 | 4.4 | 35.2 |
| | 5 | 4.0 | 39.2 | 3.1 | 35.1 |
| Comparative Example | 1 | 3.0 | 39.9 | 4.7 | 39.5 |
| | 2 | 2.8 | 31.4 | 5.0 | 35.2 |
| | 3 | 2.8 | 32.5 | 3.3 | 36.3 |

As is apparent from Table 2, a deposited film having the elongation of 3.9 to 6.3%, which is equivalent to that of the electro deposited film, can be obtained from the present electroless copper solution.

Then, electroless copper plating was carried out, using the plating solutions having the compositions of Example 1, and Comparative Example 1 to form deposited films having different film thicknesses, and relations between the film thickness and the elongation were investigated. The results are shown in FIG. 1.

As is apparent from FIG. 1, the elongation becomes effectively better in the case of the present solution composition (curve 1) than in the case of the conventional solution composition (curve 2), if the film thickness becomes larger. It is apparent that in the most practical film thickness for the printed circuit, that is, about 30 to 40 μm, elongation about 1.3 to 2 times as large as the conventional one, that is, 4.5 to 5.5%, can be obtained in the present invention.

Figure 2:
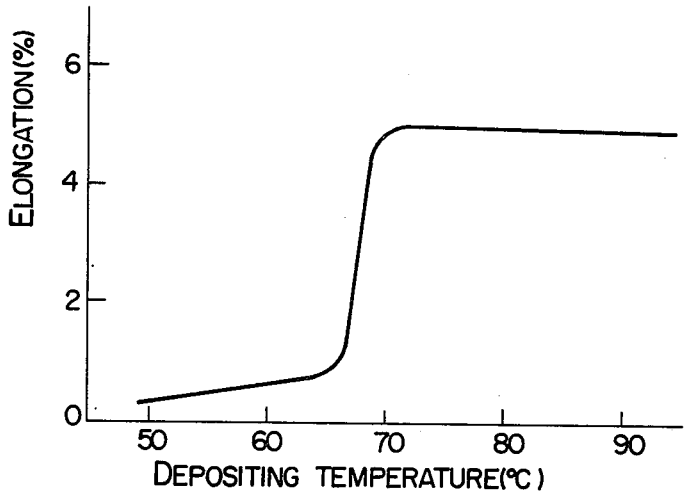
FIG. 2 is a graph showing relations between temperature of electroless copper solution, and elongation of deposited film.

Then, relations between the temperature of a plating solution and the elongation were investigated. Deposited films having a film thickness of about 35 μm were formed from the plating solution having the composition of Example 1, while changing the temperature of the plating solution. Relations between the temperature of the plating solution and the elongation are shown in FIG. 2. Though there was some random distribution in data, the curve shown in FIG. 2 was obtained, when the mean values of the data were plotted. It is apparent from FIG. 2 that good results can be obtained at the plating temperature above 70° C, but the plating temperature above 80° C is not preferable, for copper is liable to be deposited onto the plating tank walls and also onto the jigs, if the plating temperature exceeds 80° C.

Then, relations between the elongation and concentrations of copper sulfate ($CuSO_4.5H_2O$) were investigated, using the solution having the composition of Example 1, while changing only the concentration of the copper sulfate. The results are shown in FIG. 3.

Figure 3:
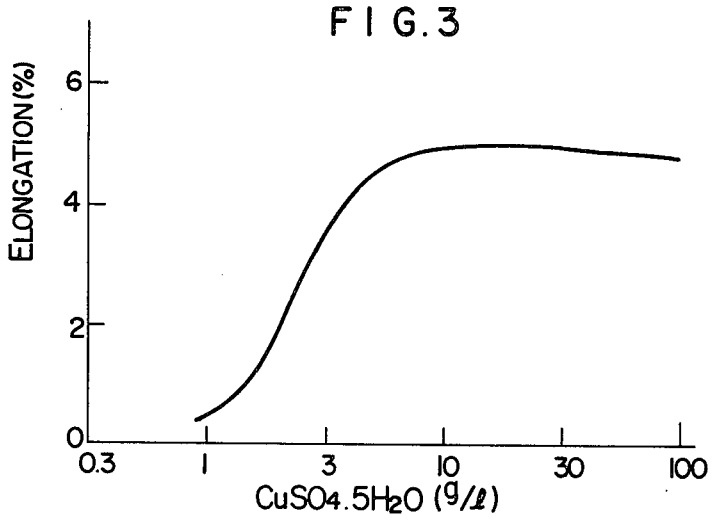
FIG. 3 is a graph showing relations between $CuSO_4.5H_2O$ concentration of electroless copper solution and elongation.

As in apparent from FIG. 3, the preferable concentration of $CuSO_4.5H_2O$ is 3 g/l or more (Cu concentration: 0.8 g/l or more) for the elongation of 3% or more. However, excessively high concentration of $CuSO_4.5H_2O$ makes the plating solution unstable, resulting in deposition of copper. Thus, the preferable range for copper sulfate concentration is 3 g/l. to 15 g/l. Generally, it is a disadvantage that the electroless copper solution has lower depositing rate than the electro copper solution, but the copper sulfate concentration of 7 g/l or more can make the depositing rate 3 μm/hr or higher.

Figure 4:
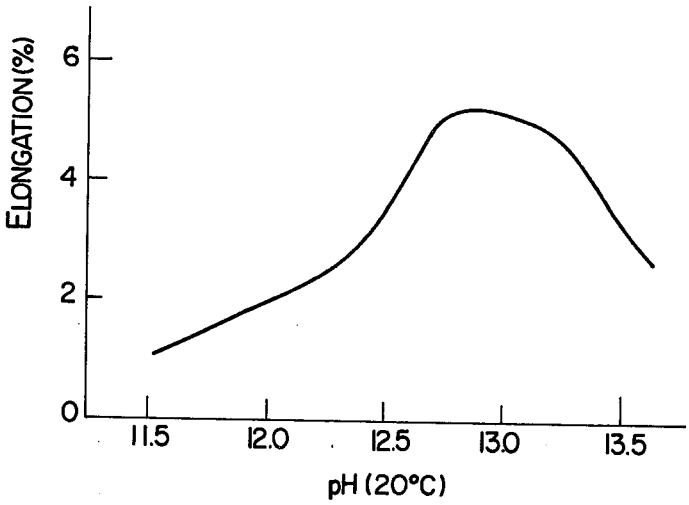
FIG. 4 is a graph showing relations between pH of electroless copper solution and elongation of deposited film.

Furthermore, the pH of the plating solution gives an influence upon the elongation. Relations between the pH and the elongation of the deposited film were investigated by plating up to a film thickness of about 35 μm at 70° C, using plating solutions having the composition of Example 1 and pH of 11.5 to 13.5 (measured at 20° C). The results are shown in FIG. 4. It is apparent from FIG. 4 that the preferable range of pH is 12.5 to 13.5 for the elongation of 3% or more.

EXAMPLES 6 - 7

Electroless copper solutions having the most appropriate compositions were selected on the basis of the results of Examples 1 to 5, and subjected to plating. Characteristics of the resulting deposited films were measured in the same manner as in Examples 1 to 5. The results are given in Table 3.

Table 3

| Example No. | 6 | 7 |
|---|---|---|
| $CuSO_4 . 5H_2O$ (g/l) | 10 | 10 |
| EDTA[1] (g/l) | 30 | 30 |
| HCHO, aqueous 37 % solution (ml/l) | 5 | 5 |
| PEG[2], molecular weight: 600 (g/l) | 20 | 20 |
| 2,2'-dipyridyl (mg/l) | 30 | — |
| 2,9-dimethyl-1,10-phenanthroline (mg/l) | — | 5 |
| pH | 12.8 | 12.8 |
| Thickness of deposited film (μm) | 38.9 | 38.4 |
| Depositing rate (μm/hr) | 3.9 | 3.2 |
| Elongation (%) | 7.0 | 4.3 |
| Tensile strength (kg/mm²) | 45.0 | 38.5 |

Note:
[1]Ethylenediaminetetraacetic acid
[2]Polyethylene glycol

Figure 5:
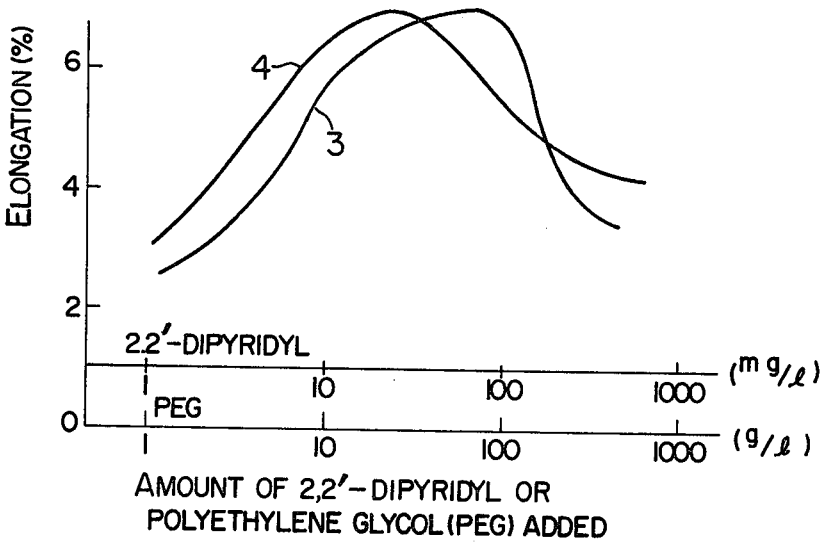
FIG. 5 is a graph showing relations between concentration of an additive of the present invention added to an electroless copper solution, and elongation of deposited film.

Relations between the amount of polyethylene glycol or 2,2'-dipyridyl and the elongation of deposited film were investigated by changing the amount of polyethylene glycol or 2,2'-dipyridyl in the solution composition of Example 6. The results are shown in FIG. 5, where curve 3 shows the case of changing the amount of 2,2'-dipyridyl added in a range of 1 to 500 mg/l, while fixing the amount of polyethylene glycol (mean molecular weight: 600) to 20 g/l, and curve 4 shows the case of changing the amount of polyethylene glycol added in a range of 1 to 500 g/l, while fixing the amount of 2,2'-dipyridyl to 30 mg/l.

EXAMPLE 8

An adhesive of phenol-modified nitrile rubber system was uniformly applied onto one side of a paper-phenol laminated board having a thickness of 1.6 mm by means of roll coating, and coated board was dried at 120° C for 0.5 hours. Then, the adhesive was also applied to the other side of the board, and heated at 170° C for one hour to effect hardening. As a result, the board having an adhesive layer of about 30 μm in thickness on both sides was obtained. Then, throughholes, 1.0 mm in diameter, were made at desired locations of said laminated board by a press.

Separately, a masking material composition was prepared by mixing 30 parts by weight of phenol novolak type epoxy resin (DEN-438, a product of Dow Chemical Corporation, USA), 50 parts by weight of melamine resin (Melan 28, a product of Hitachi Kasei Kogyo K.K., Japan), 20 parts by weight of alkyd resin (Phthalkyd 804, a product of Hitachi Kasei Kogyo K.K., Japan), and 10 parts by weight of silicone resin (ES-1001N, a product of Shinetsu Kagaku Kogyo K.K., Japan) to endow a water repellent property to the masking material composition, and further 0.5 parts by weight of 2-ethyl-4-methylimidazole, followed by dissolution in a 1 : 1 mixed solvent of methylethylketone-xylol to adjust a viscosity of the masking material composition to 250 poises (at 25° C).

The resulting masking material composition was printed and applied to plating-unnecessitating parts (negative pattern) on the one side of the board by a silk screen process, and dried at 120° C for 30 minutes. Then, said masking material composition was also applied to the negative pattern on the other side of the board, and heated at 150° C for 30 minutes to effect hardening. Thus, masking material having a thickness of 15 μm were formed on both sides of the board.

Then, the board was dipped in an etching solution prepared by dissolving 60 g of chromic anhydride ($Cr_2O_3$) and 200 ml of sulfuric acid to make 1 l at 45° C for five minutes to effect etching. Then, the board was rinsed with water, and then dipped in 5N hydrochloric acid for one minute. Then, the board was dipped in a catalyzer (HS-101B, a product of Hitachi Kasei Kogyo K.K., Japan) at room temperature for 5 minutes, then rinsed with water, dipped in an accelerating solution (ADP101, a product of Hitachi Kasei Kogyo K.K., Japan) at room temperature for 5 minutes, and then rinsed with water.

After the completion of a series of said pretreatments, the board was dipped in a treating solution prepared by dissolving 30 g of citric acid in about 3N hydrochloric acid to make 1 l, at room temperature for 5 minutes, then rinsed with water, and dipped in a plating solution having the composition of Example 6 at 72° C for 9 hours to effect electroless copper plating. A printed circuit board having an electroless deposited copper film of 35 μm in thickness at the circuit parts and inside wall of the holes was prepared. Characteristics of the resulting printed circuit board are shown in Table 4.

Comparative Example 4

A printed circuit board was prepared in the same manner as in Example 8, except that the board was dipped in the electroless plating solution of Comparative Example 1 at 72° C for 7 hours, and characteristics of the resulting printed circuit board are shown in Table 4.

Table 4

| | Punching test(1) | Heat shock test(2) | Temperature cycle test(3) | Boiling test(3) |
|---|---|---|---|---|
| Example 8 | Normal | Normal up to 10 cycles | Normal up to 50 cycles | Normal till 4 hours |
| Comparative Example 4 | Cracked breakages appeared at two locations in a line of 0.8 mm in width | Crackes appeared in 4 through-holes of 30 throughholes after 4 cycles | Cracks appeared in 2 throughholes of 30 through-holes after 28 cycles | Resistance of one throughhole of 30 throughholes reached 10 times the initial resistance after 3 hours |

Note: Testing procedures (1) After the completion of plating, the outer periphery of the printed circuit board was punched out by means of a press, and occurrence of abnormal states in the throughholes and lines was checked.

(2) The printed circuit board was dipped in glycerine at 260° ± 5° C for 5 seconds, then left at 25° C for 25 seconds, and dipped in trichlene at 25° C for 20 seconds, which constituted one cycle. Occurrence of abnormal state in the throughholes and lines was checked by repeating the cycles.

(3) Resistances of the throughholes and lines were measured by repeating one cycle of subjecting the printed circuit board to −30° C for 30 minutes → 25° C for 5 minutes → 100 ± 5° C for 30 minutes → 25° C for 5 minutes, and also occurrence of abnormal state in the appearance of the printed circuit board was checked.

(4) The printed circuit board was dipped in boiling water at 95° to 100° C, and taken out of the boiling water at every 30 minutes. After wiping out water from the board, resistances of the throughholes and lines were measured.

What is claimed is:

1. In an electroless copper solution containing an aqueous solution consisting of a copper salt, a complexing agent, a reducing agent and pH-adjusting agent, and having a high pH, the improvement wherein said copper solution further contains 5 to 300 mg/l 2,2'-dipyridyl or 1 to 50 mg/l of 2,9-dimethyl-1,10-phenanthroline and at least 1 g/l of polyethylene glycol, has a pH of 12.5 to 13.5, measured at 20° C. and is capable of providing a copper film having an elongation greater than 3%.

2. An electroless copper solution according to claim 1, the improvement wherein said copper solution contains from 3g/l to not more than 100 g/l of polyethylene glycol.

3. An electroless copper solution according to claim 2, the improvement wherein the polyethylene glycol has a molecular weight of 400 to 2,000.

4. In a electroless copper solution containing an aqueous solution consisting of a water-soluble copper salt, a complexing agent for copper ions, a reducing agent for reducing the copper salt to deposit metallic copper and an alkaline pH-adjusting agent and having a high pH, the improvement wherein said copper solution further contains 5 to 300 mg/l of 2,2'-dipyridyl or 1 to 50 mg/l of 2,9-dimethyl-1,10-phenanthroline and at least 1 g/l of polyethylene glycol having a molecular weight of 400 to 2,000 and has a pH of 12.5 to 13.5 measured at 20° C. and is at 70° to 80° C., said copper solution being capable of providing a copper film having an elongation greater than 3%.

5. An electroless copper solution according to claim 4, the improvement wherein said copper solution contains from 3 g/l to not more than 100 g/l of said polyethylene glycol.

6. In a process for forming an electroless deposited copper film by contacting a suitable substrate with an electroless copper solution containing a copper salt, a complexing agent, a reducing agent and a pH-adjusting agent and having a high pH, the improvement which comprises adding 5 to 300 mg/l of 2,2'-dipyridyl or 1 to 50 mg/l of 2,9-dimethyl-1,10-phenanthroline and at least 1 g/l of polyethylene glycol to said solution and effecting deposition of the copper film at 70°-80° C. and at a pH of from 12.5 to 13.5 measured at 20° C., said copper film having an elongation greater than 3%.

7. The process according to claim 6, wherein from 3 g/l to not more than 100 g/l of polyethylene glycol is added to said solution.

8. The process according to claim 7, wherein the polyethylene glycol added has a molecular weight of 400 to 2,000.

* * * * *